United States Patent [19]

Aaltonen et al.

[11] Patent Number: 4,478,394

[45] Date of Patent: Oct. 23, 1984

[54] APPARATUS FOR THE SEPARATION OF LEAD FROM A SULFIDIC CONCENTRATE

[75] Inventors: Olavi A. Aaltonen, Pori; Rolf E. Malmström, Helsinki; Esko O. Nermes, Turku; Tapio K. Tuominen, Espoo, all of Finland

[73] Assignee: Outokumpu Oy, Helsinki, Finland

[21] Appl. No.: 494,787

[22] Filed: May 16, 1983

Related U.S. Application Data

[62] Division of Ser. No. 254,211, Apr. 15, 1981, Pat. No. 4,391,632.

[30] Foreign Application Priority Data

Apr. 16, 1980 [FI] Finland ..... 801214

[51] Int. Cl.[3] ..... F27B 3/16

[52] U.S. Cl. ..... 266/162; 266/182

[58] Field of Search ..... 75/92, 26, 40, 46; 266/182, 161, 162

[56] References Cited

U.S. PATENT DOCUMENTS 3,326,672 6/1967 Worner ..... 75/46

4,088,310 5/1978 Noponen et al. ..... 266/161

*Primary Examiner*—M. J. Andrews

*Attorney, Agent, or Firm*—Brooks Haidt Haffner & Delahunty

[57] ABSTRACT

Lead in separated from a sulfidic concentrate by feeding a finely-divided concentrate, a silicate-high slagging agent, and air or oxygen-enriched air into the upper section of a suspension reaction shaft of a flash-smelting furnace in order to form a suspension and to oxidize the lead to lead oxide, by removing the gases via a riser pipe of the furnace and by discharging melt from a lower furnace of the flash-smelting furnace for further treatment. The slagging agent is fed at such a rate that substantially all of the melt is of the slag type and that all of the melt withdrawn from the lower furnace is directed to a reduction stage in order to reduce the lead silicate and to separate it as raw lead.

3 Claims, 2 Drawing Figures

APPARATUS FOR THE SEPARATION OF LEAD FROM A SULFIDIC CONCENTRATE

CROSS REFERENCE TO RELATED APPLICATION

This application is a division of Ser. No. 254,211 filed Apr. 15, 1981 now U.S. Pat. No. 4,391,632.

BACKGROUND OF THE INVENTION

The present invention relates to a process for the separation of lead from a sulfidic concentrate and to a flash-smelting furnace for carrying out the process.

Most of the world's lead is produced from sulfidic concentrates by the sintering-shaft-furnace process. In the sintering machine, the concentrate is oxidized in order to remove the sulfur, and it is brought to a suitable particle size for shaft furnace reduction.

The greatest disadvantage of the process is its large amounts of waste gas, which are produced by both the sintering and the shaft furnace process. It has been estimated that process and ventilation gases, which contain sulfur diozide and dust, are produced at a rate of about 670 kmol (15 000 $Nm^3$) per one tonne of concentrate. The purification of the waste gases to meet the current requirements of environmental protection causes a significant increase in the costs of lead production.

The goal of recent research work has been to create a process in which sulfur dioxide is obtained in a concentrated form and the amount of dust-bearing waste gases is minimal. In principle, a single-stage process is possible for pure concentrates which contain very little quartz. A sulfidic lead concentrate is oxidized directly to metal in a single process stage. As a sub-reaction, the lead sulfide first oxidizes to oxide in accordance with the following reaction:

$$PbS+\tfrac{3}{2}O_2=PbO+SO_2$$

Thereafter, the excess lead sulfide reduces the oxide to metallic form according to the following reaction:

$$2PbO+PbS=3Pb+SO_2$$

If the operating temperature of the process is below about 1373 K., sulfate and oxysulfates of lead are produced by the reactions instead of lead oxide. Metallic lead is produced when these compounds react with lead sulfide.

The single-stage lead production process is suitable for pure concentrates. Owing to the high mutual affinity of lead oxide and silica, the concentration of lead in the slag increases and the yield of metallic lead decreases when the concentration of quartz in the concentrate increases. Releasing the lead from the silicate requires so low an oxygen pressure that, in the presence of sulfur dioxide, lead sulfide is obtained instead of metallic lead.

At those temperatures and oxygen pressures which are used in direct production of lead, the zinc present in the concentrate oxidizes and passes into the slag. In order to maintain the melting point of the slag sufficiently low, the slag must be fluxed, which for its part increases the losses of lead into the slag.

Multiple-stage processes have therefore been applied to the treatment of the above-mentioned impure concentrates. It has been possible to eliminate the disadvantages of the sintering process, i.e. a dilute sulfur dioxide gas, the passing of lead oxide dust into the environment, the formation of sulfates, and difficulties in temperature control, by shifting to closed reactors, the product of which is a lead-oxide bearing melt. Such is, for example, the Kivcet process (FI Lay-Open Print 56028).

The vapor pressure of lead sulfide in particular, but also of lead oxide, is high at the operating temperatures of lead production processes. This is the reason for the large amounts of fly dust, which are typical of the process and very detrimental. In both a multiple-stage and a single-stage process there occurs volatilization of both sulfide and oxide of lead. The boiling point of lead sulfide is about 1610 K. and that of lead oxide about 1810 K., and so the gas may contain large amounts of the said compounds at the processing temperatures. The volatilized lead compounds leave the processing apparatus along with the sulfur-dioxide bearing gas.

Depending on the sulfur dioxide pressure, only the sulfide, sulfate and various oxysulfates of lead are stable below 1050–1150 K. For this reason, the dust separated from the cooled gas, the amount of the dust possibly representing a very high proportion of the lead amount fed into the process, primarily consists of these compounds. The amount of lead oxide is less. Feeding the fly dust to the oxide reduction stage is not possible owing to the sulfur present in it. During the reduction stage the sulfur would be reduced and would leave along with the gas in the form of lead sulfide. Likewise, the concentration of sulfur in the lead produced would be high. The most common method of treating the dust is to feed it, together with fresh concentrate, back to the oxidation stage. However, there is a disadvantage in the amount of energy required by the endothermal decomposition reactions of the sulfates and in the increased amount of gas in the process owing to the high rate of recycling of dust.

One of the main objectives in the development of the lead process has been to decrease the amounts of dust. One method for achieving this has been to cool the gas in the outlet section of the oxidation reactor in such a manner that the compounds of lead condense and fall back into the hot melt. This procedure is used in the Kivcet process when lead concentrate is oxidized. The return of the cooled dust, which possibly contains sulfates, causes, however, additional consumption of heat, since the amount of dust is high, 25–40%.

Another method used in several processes in order to decrease the dust amount is to inject sulfide concentrate either into the surface or below the surface of the melt in the furnace. Thereby the sulfide is caused either to dissolve rapidly in the molten lead or to react with the lead oxide present in the slag, whereby the activity of the lead sulfide decreases and volatilization decreases.

Finnish Pat. No. 54147 discloses a process for the suspension smelting of sulfidic complex and/or mixed ores or concentrates by feeding a finely divided raw material, air or oxygen-enriched air, and possibly fuel into the upper section of the reaction zone in order to form a suspension, whereby the raw material in suspension is exposed to an oxidizing treatment at a high temperature in the upper section of the reaction zone and to a reducing or sulfidizing treatment in the lower section of the reaction zone in order to cause the non-volatile impurity minerals or impurity metals to pass back into the gas phase before the solid in the suspension separates and impinges on the melt surface below the reaction zone.

In this patent is is pointed out that often it is not possible to remove the lead quantitatively from the products of the smelting without effective reduction-sulfidization, since the lead oxide produced during the oxidation readily reacts in the shaft with the concentrate or the silicic acid of the additives fed. It is noted that, owing to the disadvantageous activity conditions, it is difficult to reduce the lead and to sulfidize it out from molten silicates.

None of the above-described processes is capable of decisively decreasing the dust problem in the lead production process. A large part of the lead content of the concentrate continues to leave along with the gas and is sulfated or sulfidized during the cooling of the gas.

The objective of the present invention is to eliminate substantially the dust problems occurring in the above-mentioned prior known processes and to provide a process for the separation of lead from a sulfidic concentrate.

A further objective of the invention is to provide a flash-smelting furnace intended for use in this new process, a furnace in which retention of the melt is not necessary and in which the dust amount carried along by the discharging gas in decisively less than in prior known corresponding apparatus.

SUMMARY OF THE INVENTION

The present invention is based on the concept that the aim is to slag all the lead present in the sulfidic concentrate, and in order to ensure this, a silicate-high slagging agent is added at such a rate that substantially only a slag-type melt is produced in the furnace, and by a reduction of this melt, raw lead and slag are obtained, the slag being advantageously usable as the said silicate-high slagging agent.

The slagging agent can be fed not only into the reaction shaft but also into the lower furnace and/or the rising-flow zone, and advantageously this additional amount is fed at such a point where a strong gas turbulence prevails, for example, into the lower section of the rising-flow zone.

The slagging agent used can be advantageously a finely-divided quartz sand, but also a low-lead and/or high-silicate lead silicate, so-called lead glass, can be used, e.g. the low-lead silicate-high slag obtained from the separation of raw lead, and it is fed either in molten stage or as a finely-divided solid.

Since the aim is to obtain all of the melt as a slag-type melt, no phase separation is required and thus no retention of the melt is necessary. Thus very high gas velocities can be used in the lower furnace, whereby, according to experience, the amount of mechanical dust decreases and the lower furnace can be dimensioned rather small, preferably consisting of a chamber having the form of a horizontal cylinder with a diameter of about 3–5 m, e.g. 4 m.

The aim is to maintain so high a temperature and oxygen pressure in the furnace that all of the lead present in the sulfide concentrate oxidizes to lead oxide, which combines with the slagging agent to form a solid or molten substance which falls into the melt on the floor of the furnace. The temperature of the suspension is adjusted at minimum to 1373 K. and the oxygen pressure to a value higher than $5.10^{-10}$ atm, and the temperature is adjusted at maximum to 1873 K. at an oxygen pressure which is higher than $6.10^{-6}$ atm.

Thus, in the present invention, use is made of the observation that, by controlling the temperature, mixing and oxygen pressure of the suspension, the lead can be oxidized to lead oxide and can at the same time be effectively bound by means of so-called binding agents or slagging agents to molten or solid lead silicates, which fall onto the furnace floor and there form a slag-type melt. Thereby the formation of gaseous lead compounds and the formation of sulfate dust are avoided when the gases are cooled in a boiler located beyond the furnace.

DESCRIPTION OF THE PREFERRED EMBODIMENT

Figure 2:
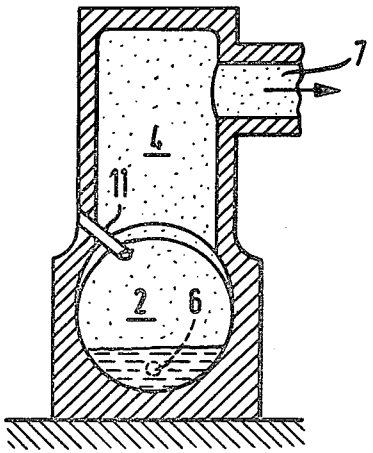
FIG. 2 is a section along line A—A in FIG. 1.
Figure 1:
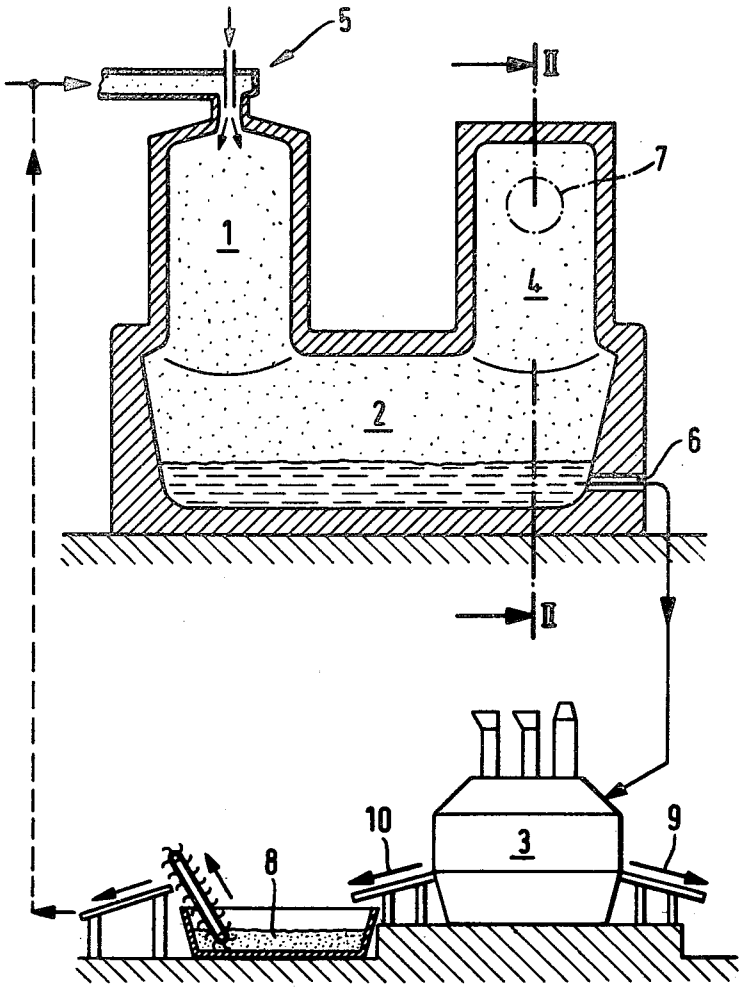
FIG. 1 is a cross-sectional side elevation of a furnace apparatus intended for use in connection with the process according to the invention.

The lead concentrate and the above-mentioned slagging binding agents are fed through the vault of the reaction shaft 1 of the flash-smelting furnace, i.e. suspension smelting furnace, by means of special dispersers 5, in which oxygen or oxygen-enriched air is used as a medium in order to form a good suspension. Furthermore, additional oxygen and/or oxygen-enriched air and additional fuels (liquid or solid, carbon- and/or hydrogen-bearing) are fed in order to control the oxidation and the thermal balance. Concentrate and the said binding agent are fed in such proportions and so as to maintain such physical suspension conditions that a nearly complete oxidation of the lead to oxides and a nearly complete reaction of these oxides to molten or solid lead silicates are achieved. When the direction of the lead silicate suspension in the flash smelting furnace is changed by 90°, most of the melt/solid of the suspension separates from the gas and settles on the floor of the lower furnace 2, from where it is discharged via an opening 6 into the electric furnace 3, in which the lead silicate is reduced by means of, for example, coke and/or iron to raw lead 9, which is separated from the lead-low silicate slag 10, which is granulated 8. The sulfur-dioxide bearing gas separated from the suspension in the lower furnace 2 contains mechanical dust and a certain amount of gaseous lead oxides. In the rear section of the lower furnace, the gas flow is throttled (velocity 40–100 m/s), and binding agents are also added to this turbulent flow via the feeder pipe 11, at which time the gaseous lead oxide present in the gas further combines to form molten/solid lead silicates, and at the same time the gas cools, whereby the possible slight amount of gaseous lead oxide condenses, forming lead oxide melt. Thereafter the gases contain practically only mechanical dust (molten or solid), which separates, at which time the mechanical dust flows to the floor of the lower furnace 2 and thus joins the main part of the lead silicate slag, which is discharged 6 from the lower furnace 2 to the electric-furnace reduction 3, in which raw lead 9 is produced.

The temperature of the gas leaving the riser pipe 4 via the outlet pipe 7 is about 1000°–1100° C., and it contains dust only about 2–15% calculated from the feed. The outlet gas and the dust are directed to a boiler, in which the gas is cooled to about 300–350 degrees by producing high-pressure vapor (60–100 atm). Thereby the dusts are sulfated, and they are removed, from below, from the boiler and from the electric filter situated beyond the boiler, and transferred pneumatically to a dust silo, from which the dust is refed into the reaction shaft 1 of the flash smelting furnace.

Owing to the nature of the process, no retention time for the settling of the lead silicate slag is required in the lower furnace 2, as is required in, for example, the flash smelting of copper and nickel, since the valuable metals and the lead are in this case in the slag, and so the settling of the valuable metals from the slag into the matte and/or metal phase need not be carried out. It is also due to the nature of the process that the reactions and the combining of lead oxides to form lead silicates are sufficiently rapid. Furthermore, considerations of environmental protection require that the furnace structure is such that no gas leaks can occur.

The last three viewpoints make it possible to use a small furnace size in proportion to the capacity. On the basis of pilot plant experiments, it can be estimated that for a capacity of 200,000–300,000 tonnes of lead concentrate/year a suitable furnace size is one in which the reaction shaft diameter is about 3 m and height about 5 m, the lower furnace diameter is about 4 m and length about 10 m, and the riser pipe diameter is about 3 m and height about 5 m. It should be noted that it is advantageous to use a flash-smelting furnace in which the transverse cross section of the lower furnace is circular, contrary to a normal flash smelting furnace, in which the transversal cross section is rectangular. A horizontal small cylindrical lower furnace structure can be used because retention of melt is not required and the gas flow velocity can be maintained high, 10–20 m/s. According to experience, the amount of mechanical dust is thereby decreased.

The invention is described below in greater detail by way of the following examples.

EXAMPLE 1

The analysis of the lead concentrate is

| | |
|---|---|
| Pb | 43.0% |
| Cu | 1.5% |
| Fe | 5.0% |
| Zn | 3.9% |
| S | 12.3% |
| Sb | 0.2% |
| $SiO_2$ | 16.9% |
| CaO | 3.2% |
| MgO | 6.1% |

The feed into the reaction shaft of the furnace is

| | |
|---|---|
| concentrate | 3000 kg/h |
| butane | 91 " |
| oxygen | 612 $Nm^3/h$ |
| fly dust | 1818 kg/h |

and, in addition, flux (lime)

The shaft temperature is 1600 K.

Gases are formed in the shaft at 821 $Nm^3/h$

| | |
|---|---|
| $SO_2$ | 47.5% |
| $CO_2$ | 17.1% |
| $H_2O$ | 21.4% |
| $N_2$ | 0.4% |
| PbO | 13.6% |

In the lower furnace, butane is burned at 51 kg/h in order to compensate for the temperature losses, and so the rate of gas in the rising shaft is 997 $Nm^3/h$

| | |
|---|---|
| $SO_2$ | 39.1% |
| $CO_2$ | 21.9% |
| $H_2O$ | 27.4% |
| $N_2$ | 0.4% |
| PbO | 11.2% |

When the gases cool, both gaseous PbO and the PbO carried by the gas flow (mechanical dust) react with the $SO_2$, thereby forming sulfate and sulfide (1), $$4PbO+4SO_2 \rightarrow 3PbSO_4+PbS \quad (1)$$

Most of the dusts (1818 kg/h) are thus formed through the gas phase. At a temperature of 1600 K., the gas phase can contain at maximum 14.3% PbO (Barin & Knocke: Thermochemical properties of inorganic substances). The cooled dusts contain:

| | |
|---|---|
| $PbSO_4$ | 77.9% |
| PbS | 20.5% |

which are returned to the furnace.

EXAMPLE 2

The concentrate of Example 1 is used.

Feeds to the reaction shaft:

| | |
|---|---|
| concentrate | 3000 kg/h |
| butane | 35 kg/h |
| oxygen | 472 $Nm^3/h$ |
| fly dust + lime | 271 kg/h |

The shaft temperature is 1600 K.

Gases are formed in the shaft at 460 $Nm^3/h$

| | |
|---|---|
| $SO_2$ | 58.5% |
| $CO_2$ | 11.9% |
| $H_2O$ | 14.8% |
| $N_2$ | 0.5% |
| PbO | 14.3% |

In the lower furnace, butane is burned at 51 kg/h in order to compensate for the thermal losses and a binding agent (1) is used at 177 kg/h in order to combine gaseous lead oxide to form $PbO.SiO_2$. The vapor pressure of lead oxide above the $PbO.SiO_2$ at 1600 K. is 0.030 atm. After the reaction has taken place, the gas phase in the riser pipe is (1600 K.) gases 588 $Nm^3/h$

| | |
|---|---|
| $SO_2$ | 45.7% |
| $CO_2$ | 22.6% |
| $H_2O$ | 28.2% |
| $N_2$ | 0.5% |
| PbO | 3.0% |
| PbO dust | 11.8 kg/h |

In the separator, the PbO which is bound in the silicate flows back into the furnace in a molten state. As in Example 1, the PbO which has passed the separator (in gas 3%+in molten state 11.8 kg/h) forms, when cooling, sulfates and sulfides, which are returned to the reaction shaft as fly dust.

EXAMPLE 3

The concentrate of Example 1 is used.

Feeds into the reaction shaft:

| | |
|---|---|
| concentrate | 3000 kg/h |
| butane | 21 kg/h |
| oxygen | 436 $Nm^3/h$ |
| fly dust + lime | 61 kg/h |

Shaft temperature is 1600 K.

Gases are formed in the shaft at 382 $Nm^3/h$

| | |
|---|---|
| $SO_2$ | 65.9% |
| $CO_2$ | 8.5% |
| $H_2O$ | 10.7% |
| $N_2$ | 0.6% |
| PbO | 14.3% |

In the lower furnace, butane is burned at 51 kg/h and a binding agent (1) is used at 177 kg/h in order to combine the gaseous lead oxide to form $PbO.SiO_2$. The gases are cooled to 1400 K., at which the vapor pressure of the lead oxide above $PbO.SiO_2$ is 0.0023 atm. After the reaction has taken place, the gas phase in the rising shaft contains gases 505 $Nm^3/h$

| | |
|---|---|
| $SO_2$ | 49.9% |
| $CO_2$ | 21.9% |
| $H_2O$ | 27.4% |
| $N_2$ | 0.6% |
| PbO | 0.23% |
| PbO dust | 12.5 kg/h |

In the conical separator, the PbO bound in silicate flows back into the furnace in a molten state. As in Example 1, the PbO which has passed the separator (in gas 0.23% + 12.5% in a molten state) forms, when cooling, sulfates and sulfides, which are returned to the reaction shaft as fly dust.

Vapor pressure of lead oxide above the lead silicates (fly dusts)

The reactions $$PbO_{(g)} + SiO_{2(s)} \rightarrow PbO.SiO_{2(l)} \quad (1)$$

$$2PbO_{(g)} + SiO_{2(s)} \rightarrow 2PbO.SiO_{2(l)} \quad (2)$$

are observed at 1600, 1500 and 1400 K.

The particle pressure of $PbO_{(g)}$ above the silicate can be calculated with the aid of $\Delta G$ from Reaction Equations (1) and (2)

$$(1) \longrightarrow kp_1 = \frac{a_{PbO \cdot SiO_2}}{a_{SiO_2} \cdot PbO}$$

$$(2) \longrightarrow kp_2 = \frac{a_{2PbO \cdot SiO_2}}{a_{SiO_2} \cdot p^2_{PbO}}$$

By assuming that $SiO_2$ does not dissolve in the lead glass, $$kp_1 = \frac{1}{p_{PbO}} \Longrightarrow p_{PbO}' = \frac{1}{kp_1}$$

$$kp_2 = \frac{1}{p^2_{PbO}} \Longrightarrow p_{PbO}'' = \frac{1}{kp_2}$$

TABLE 1

| | Vapor pressures of PbO, atm | | |
|---|---|---|---|
| T/K | A | B | C |
| 1400 | 0.0185 | 0.0023 | 0.0028 |
| 1500 | 0.055 | 0.0092 | 0.0102 |
| 1600 | 0.143 | 0.030 | 0.033 |

A Above a PbO melt
B Above a $PbO.SiO_2$ melt
C Above a $2pbO.SiO_2$ melt

What is claimed is:

1. A flash smelting furnace for the separation of lead from a sulfidic concentrate, comprising a lower furnace having a substantially circular cross-section; a vertically oriented reaction shaft connected to the lower furnace at the lower end of the reaction shaft so that non-gaseous products of reaction in the reaction shaft settle on a floor of the lower furnace; means for feeding a finely-divided lead concentrate, a silicate-high slagging binding agent, and air or oxygen-enriched air into said reaction shaft to react therein; a rising shaft rising generally vertically from said lower furnace, said rising shaft being spaced and separated from said reaction shaft; means for discharging a melt from the lower furnace; means for removing gas via said rising shaft; and pipe means for feeding additional slagging binding agent into the lower furnace beneath the rising shaft.

2. The flash-smelting furnace of claim 1, in which the means for withdrawing melt from the lower furnace comprise one single outlet for the entire melt amount.

3. The flash-smelting furnace of claim 1, in which the diameter of the lower furnace is about 3–5 m.

* * * * *

UNITED STATES PATENT AND TRADEMARK OFFICE

CERTIFICATE OF CORRECTION

PATENT NO. : 4,478,394

DATED : October 23, 1984

INVENTOR(S) : Olavi A. Aaltonen et al

It is certified that error appears in the above-identified patent and that said Letters Patent is hereby corrected as shown below:

Column 8, lines 16 and 18:

$$\text{"}\ kp1 = \frac{1}{PPbO} \Rightarrow PPbO' = \frac{1}{kp1}\ \text{"}$$

$$\text{"}\ kp2 = \frac{1}{{}^{2}PPbO} \Rightarrow PPbO'' = \frac{1}{kp2}\ \text{"}$$

should read:

$$\text{--}\ kp_1 = \frac{1}{p^2_{PbO}} \Rightarrow p'_{PbO} = \frac{1}{kp_1}\ \text{--}$$

$$\text{--}\ kp_2 = \frac{1}{p^2_{PbO}} \Rightarrow p''_{PbO} = \frac{1}{kp_2}\ \text{--}.$$

Signed and Sealed this

*Eighteenth* Day of *June 1985*

[SEAL]

*Attest:*

DONALD J. QUIGG

*Attesting Officer* *Acting Commissioner of Patents and Trademarks*